US008147386B2

(12) United States Patent
Farnsworth et al.

(10) Patent No.: US 8,147,386 B2
(45) Date of Patent: Apr. 3, 2012

(54) INTEGRAL TREADMILL RESISTANCE TRAINING APPARATUS

(75) Inventors: Rick Farnsworth, Brush Prairie, WA (US); Douglas G Dixon, Longview, WA (US)

(73) Assignee: AVERO Fitness LLC, Brush Prairie, WA (US)

( * ) Notice: Subject to any disclaimer, the term of this patent is extended or adjusted under 35 U.S.C. 154(b) by 71 days.

(21) Appl. No.: 12/607,871

(22) Filed: Oct. 28, 2009

(65) Prior Publication Data

US 2010/0279827 A1 Nov. 4, 2010

Related U.S. Application Data

(60) Provisional application No. 61/109,092, filed on Oct. 28, 2008.

(51) Int. Cl.
*A63B 22/02* (2006.01)

(52) U.S. Cl. ..... 482/54; 482/121

(58) Field of Classification Search ..... 482/51, 482/54, 52, 92, 121, 122, 123, 126, 127, 482/128, 129, 148, 57, 62, 130, 139
See application file for complete search history.

(56) References Cited

U.S. PATENT DOCUMENTS

| | | | | |
|---|---|---|---|---|
| 1,019,861 | A | 3/1912 | Titus | |
| 1,390,095 | A | 9/1921 | Dettinger et al. | |
| 2,919,134 | A | 12/1959 | Zuro | |
| 4,304,402 | A | 12/1981 | Ripp | |
| 4,625,962 | A | 12/1986 | Street | |
| 4,979,731 | A | 12/1990 | Hermelin | |
| 5,013,035 | A | 5/1991 | Nathaniel | |
| 5,178,591 | A | 1/1993 | Lyons | |
| 5,254,064 | A | 10/1993 | Rock | |
| 5,269,737 | A | 12/1993 | Sobotka | |
| 5,277,684 | A * | 1/1994 | Harris | 482/130 |
| 5,405,305 | A | 4/1995 | Wilkinson et al. | |
| 5,584,783 | A | 12/1996 | Hagg et al. | |
| 5,632,708 | A | 5/1997 | Wilkinson et al. | |
| 5,803,874 | A * | 9/1998 | Wilkinson | 482/54 |
| 5,997,448 | A | 12/1999 | Duba | |
| 6,520,891 | B1 | 2/2003 | Stevens, Jr. | |
| 2004/0204294 | A2 * | 10/2004 | Wilkinson et al. | 482/54 |
| 2005/0124471 | A1 * | 6/2005 | Wilkinson | 482/121 |
| 2007/0191197 | A1 * | 8/2007 | Vittone et al. | 482/121 |

* cited by examiner

*Primary Examiner* — Loan Thanh
*Assistant Examiner* — Tam Nguyen
(74) *Attorney, Agent, or Firm* — Mark E. Beatty; Kurt M. Rylander; Rylander & Associates PC.

(57) ABSTRACT

An integral treadmill resistance training apparatus includes a treadmill having a treadway; left and right support columns, each support column including a base portion connected to the treadmill and an upper portion extending upward from the base portion; first and second translation members, each of the first and second translation members rotatingly connected to the left and right support column upper portions, respectively, at a translation axis, each of the translation members including one or more resistance strap connection points radially distal from the translation axis; first and second articulated handles connected to the first and second translation members, respectively; first and second handle locking mechanisms engageable with the first and second translation members and the first and second handles, respectively; and, one or more resistance straps removably connectable between each of the first and second translation members and the left and right support columns, respectively.

22 Claims, 9 Drawing Sheets

INTEGRAL TREADMILL RESISTANCE TRAINING APPARATUS

CROSS-REFERENCE TO RELATED APPLICATIONS

The present application is a nonprovisional application of, and claims priority to, U.S. Provisional Application Ser. No. 61/109,092, filed Oct. 28, 2008, which is hereby incorporated by reference into this application.

FIELD OF THE INVENTION

The present invention relates to resistance training exercise apparatus. More particularly, the present invention relates to exercise treadmills with integral resistance training means for resistance training strength workouts.

BACKGROUND

Home exercise machines are widespread. Some machines provide aerobic exercise, such as treadmills and other "cardio machines," Some machines provide strength training such as weight machines and resistance machines using elastic straps or resistance gears. Examples include such suppliers as BOWFLEX™ and NAUTILUS™. These machines have drawbacks, however. These machines are essentially single purpose—they provide either a cardio workout or a strength workout, but can't provide for both in the same footprint. Most people have limited space in their home or office to store and use exercise equipment and don't have room for both a cardio machine and a strength machine. These machines can also be quite expensive. The cost of purchasing a stand-alone cardio machine and a stand-alone strength machine can be prohibitive for many. Limited space available in user's homes may also preclude two separate machines.

An effective strength training machine should provide for multiple positions and multiple angles of resistance in order to work different muscle groups. An effective strength training machine should provide for exercises in the supine and standing positions. Users would benefit greatly from being able to integrate strength training exercises into a single cardio-strength training machine rather than have to obtain separate machines.

Thus, there is a need for an apparatus which integrates an exercise treadmill with strength training means into a single machine without negating its ability to operate as a treadmill.

A number of devices have provided treadmills or resistance exercises, but lack the ability to integrate the two together to create an operating treadmill for resistance training, with the ability to perform exercises in a sitting or supine position as well as while walking on the treadmill. Presently known art attempts to address this problem, but has not completely solved the problem. The following represents a list of known related art

| Reference: | Issued to: | Date of Issue: |
|---|---|---|
| US 2007/0191197 A1 | Vittone et al. | pub. Aug. 16, 2007 |
| U.S. Pat. No. 6,520,891 B1 | Stevens, Jr. | Feb. 18, 2003 |
| U.S. Pat. No. 5,997,448 | Dubna | Dec. 7, 1999 |
| U.S. Pat. No. 5,632,708 | Wilkinson et al. | May 27, 1997 |
| U.S. Pat. No. 5,584,783 | Hagg et al. | Dec. 17, 1996 |
| U.S. Pat. No. 5,405,305 | Wilkinson et al. | Apr. 11, 1995 |
| U.S. Pat. No. 5,269,737 | Sobotka | Dec. 14, 1993 |
| U.S. Pat. No. 5,254,064 | Rock | Oct. 19, 1993 |

-continued

| Reference: | Issued to: | Date of Issue: |
|---|---|---|
| U.S. Pat. No. 5,178,591 | Lyons | Jan. 21, 1993 |
| U.S. Pat. No. 5,013,035 | Nathaniel | May 7, 1991 |
| U.S. Pat. No. 4,304,402 | Ripp | Dec. 8, 1981 |
| U.S. Pat. No. 2,919,134 | Zuro | Dec. 29, 1959 |
| U.S. Pat. No. 1,390,095 | Dettinger et al. | Sep. 6, 1921 |
| U.S. Pat. No. 1,019,861 | Titus | Mar. 12, 1912 |

The teachings of each of the above-listed citations (which does not itself incorporate essential material by reference) are herein incorporated by reference. None of the above inventions and patents, taken either singularly or in combination, is seen to describe the instant invention as claimed.

U.S. Patent Publication 2007/0191197A1, by Vittone et al., teaches an exercise machine including an elastic band and a tension fulcrum positioned so that the band extends around the tension fulcrum to provide resistance exercise to the user. The system is designed as an integral machine, with individually moving vertically oriented handles, operating in a motion akin to cross country skiing. Vittone does not teach apparatus or methods for converting an existing treadmill to provide strength training. Vittone does not teach apparatus or methods permitting strength exercises from a supine position.

U.S. Pat. No. 6,520,891 B1, to Stephens, teaches a treadmill integrated with a lever handle attached to a height adjustable stanchion with spring tensioners providing resistance. Stephens does not teach apparatus or methods for converting an existing treadmill to provide strength training. Stephens does not teach apparatus or methods permitting strength exercises from a supine position.

U.S. Pat. No. 5,997,448, to Dubna, teaches a strength exercise apparatus using elastic bands for resistance. The bands are attached to a fixed post with height-adjustable cross piece. Dubna does not teach apparatus or methods for converting an existing treadmill to provide strength training. Dubna does not teach apparatus or methods permitting strength exercises using a treadmill from a supine position.

U.S. Pat. No. 5,632,708 and U.S. Pat. No. 5,405,305, to Wilkinson et al, consist of an elastic band attached to a bicycle or treadmill. The user pulls directly on the elastic band for resistance exercise. Wilkinson does not teach the use of a translation wheel. Wilkinson does not teach Wilkinson does not teach apparatus or methods permitting strength exercises using a treadmill from a supine position.

U.S. Pat. No. 5,584,783, to Hagg at al, teaches a system for modifying a stationary bicycle for strength exercises by attaching longitudinal rails to the base of the stationary bicycle and attaching elastic bands to the rails using sliding clamps. Hagg does not teach apparatus or methods for converting an existing treadmill to provide strength training. Hagg does not teach the use of a translation wheel. Hagg does not teach apparatus or methods permitting strength exercises using a treadmill from a supine position.

U.S. Pat. No. 5,269,737, to Sobotka, teaches an exercise device for exercising the oblique and upper torso muscles using elastic bands. Sobotka does not teach apparatus or methods for converting an existing treadmill to provide strength training. Sobotka does not teach the use of a translation wheel. Sobotka does not teach apparatus or methods permitting strength exercises using a treadmill from a supine position.

U.S. Pat. No. 5,254,064, to Rock, teaches the use bare elastic cords attached to a center post of an exercise treadmill for strength training. Operation requires the user pull directly on the cords using hand rings. Rock does not teach the use of a translation wheel. Rock does not teach apparatus or methods permitting strength exercises using a treadmill from a supine position.

U.S. Pat. No. 5,178,591 to Lyons teaches a T-bar attachment for a central post of a stair-stepper machine. The central T-bar includes hooks for elastic straps which straps a user can use for exercises. Operation requires the user pull directly on the cords using hand rings. Lyons does not teach the use of a translation wheel. Lyons does not teach apparatus or methods permitting strength exercises using a treadmill from a supine position.

U.S. Pat. No. 5,013,035, to Nathaniel, teaches a vertical arched frame with attachment points for elastic bands which can be used for resistance exercises. Operation requires the user pull directly on the cords using hand rings. Nathaniel does not teach the use of a translation wheel. Nathaniel does not teach adapting a treadmill for resistance exercise training. Nathaniel does not teach apparatus or methods permitting strength exercises using a treadmill from a supine position.

U.S. Pat. No. 4,304,402, to Ripp, teaches an exercise apparatus using elastic bands where a user anchors one end with their feet and pulls the opposite end of the straps, which are connected to a handle. Operation requires the user pull directly on the cords using a hand grip. Ripp does not teach the use of a translation wheel. Ripp does not teach adapting a treadmill for resistance exercise training. Ripp does not teach apparatus or methods permitting strength exercises using a treadmill from a supine position.

U.S. Pat. No. 2,919,134, to Zuro, teaches an expandable rod, for inserting horizontally between vertical walls, which rod includes connections for springs usable for resistance training. Operation requires the user pull directly on the springs using hand rings, Zuro does not teach the use of a translation wheel. Zuro does not teach adapting a treadmill for resistance exercise training. Zuro does not teach apparatus or methods permitting strength exercises using a treadmill from a supine position.

U.S. Pat. No. 1,390,095, to Dettinger et al, is similar to Zuro, teaching an adjustable frame which can be anchored to a wall and adjoining floor, anchoring springs usable for resistance training. Operation requires the user pull directly on the springs using hand rings. Dettinger does not teach the use of a translation wheel. Dettinger does not teach adapting a treadmill for resistance exercise training. Dettinger does not teach apparatus or methods permitting strength exercises using a treadmill from a supine position.

U.S. Pat. No. 1,019,861, to Titus, teaches a device essentially similar to Ripp: an exercise apparatus using elastic bands where a user anchors one end with their feet and pulls the opposite end of the straps, which are connected to a handle. Operation requires the user pull directly on the cords using a hand grip. Titus does not teach the use of a translation wheel. Titus does not teach adapting a treadmill for resistance exercise training. Titus does not teach apparatus or methods permitting strength exercises using a treadmill from a supine position.

As can be seen, the foregoing body of art does not provide for: (1) apparatus and methods to integrate strength training with a wide range of motion and exercises into a treadmill for strength training; (2) which allows continued use of the treadmill as a treadmill; (3) which includes angular adjustments for the arms; (4) which includes articulated arms; (5) which can be used for upper body strength exercises from both a standing and a supine position; (6) which may incorporate an exercise bench mountable over a treadmill.

SUMMARY AND ADVANTAGES

An integral treadmill resistance training apparatus includes a treadmill having forward end, an aft end, and a treadway; left and right support columns, each of the support columns including a base portion connected to the treadmill and an upper portion extending upward from the base portion; first and second translation members, each of the first and second translation members rotatingly connected to the left and right support column upper portions, respectively, at a translation axis, each of the translation members including one or more resistance strap connection points radially distal from the translation axis; first and second handles connected to the first and second translation members, respectively; first and second handle locking mechanisms engageable with the first and second translation members and the first and second handles, respectively; and, one or more resistance straps removably connectable between each of the first and second translation members and the left and right support columns, respectively. An integral treadmill resistance training apparatus may include, wherein each of the first and second handles includes an articulation joint and an articulation joint locking mechanism engageable at selected angles. An integral treadmill resistance training apparatus may include, wherein the articulation joint includes an adjustable rotational resistance mechanism. An integral treadmill resistance training apparatus may include, wherein each of the one or more resistance straps removably connectable between each of the first and second translation members and the left and right support columns, respectively, comprises a plurality of resistance straps connected in opposing orientation, such that resistance is created when rotating the translation member in either the clockwise or counter-clockwise directions. An integral treadmill resistance training apparatus may include first and second resistance strap pre-tensioners. An integral treadmill resistance training apparatus may include wherein the left and right support column base portions are adjustably connected to the treadmill so as to vary the lateral separation between the left and right support columns. An integral treadmill resistance training apparatus may include, further comprising: wherein each of the left and right support column upper portions includes a sleeve adjustably mounted to the support column, and wherein each of the translation members connects to a respective right or left support column sleeve. An integral treadmill resistance training apparatus may include first and second adjustable grips, each of the adjustable grips including a first portion rotatably and slidingly connected to the first and second handles, respectively, a hand grip portion extending from and offset from the first portion, and a locking mechanism releasably engageable with the first portion and the handle.

The integral treadmill resistance training apparatus of the present invention presents numerous advantages, including: (1) apparatus and methods to integrate strength training with a wide range of motion and exercises into a treadmill for strength training; (2) which allows continued use of the treadmill as a treadmill; (3) which includes angular adjustments for the arms; (4) which includes articulated arms which can incorporate variable resistance; (5) which can be used for upper body strength exercises from both a standing and a supine position; (6) which may incorporate an exercise bench mountable over a treadmill; (7) which conserves space by combining resistance training mechanisms into a treadmill; (8) which significantly increases cardiovascular conditioning by incorporating strength exercises while walking on the treadmill. (9) The adjustability of the angle of the handle to the translation member and the articulated handle joints allow users of differing heights to make the machine fit their body proportions. (10) The angular adjustability also permits the user to focus on different muscle groups or make adjustments based on the speed of the treadmill treadway. (11) The user can select and lock the articulated joints to ensure ergonomically correct wrist angle, or may unlock the joints to utilize the variable resistance capabilities of the joints. (12)

Adjustable grips allow a user to widen or narrow their grip to emphasize different muscle groups, or to accommodate a bigger body. (13) The apparatus can be used while the treadmill treadway is running to increase the intensity of cardiovascular training, or can be used with the treadway stopped for more traditional strength training exercises.

Additional advantages of the invention will be set forth in part in the descriptions which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

Figure 1:
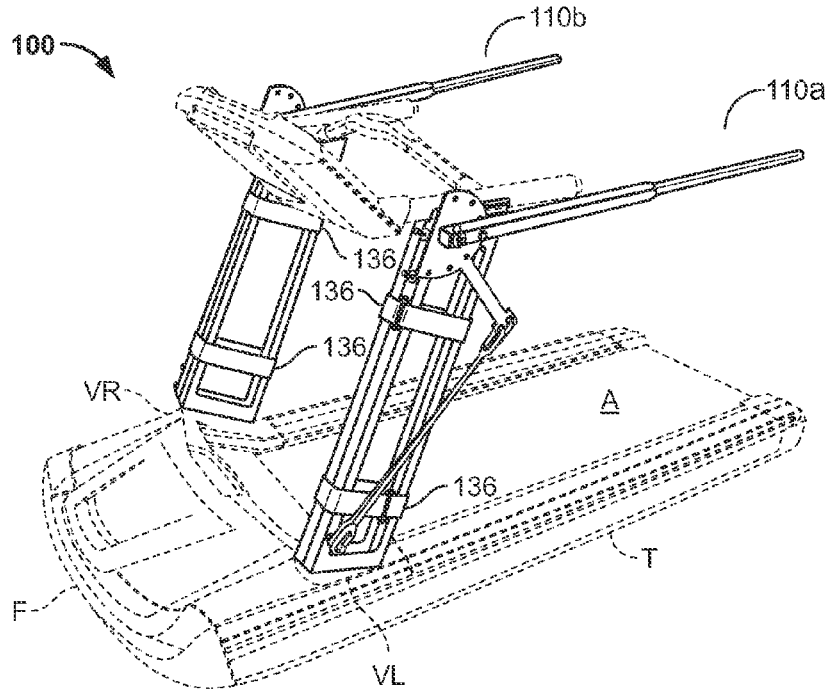
FIG. 1 shows a front perspective view of a first embodiment of the invention.
Figure 2:
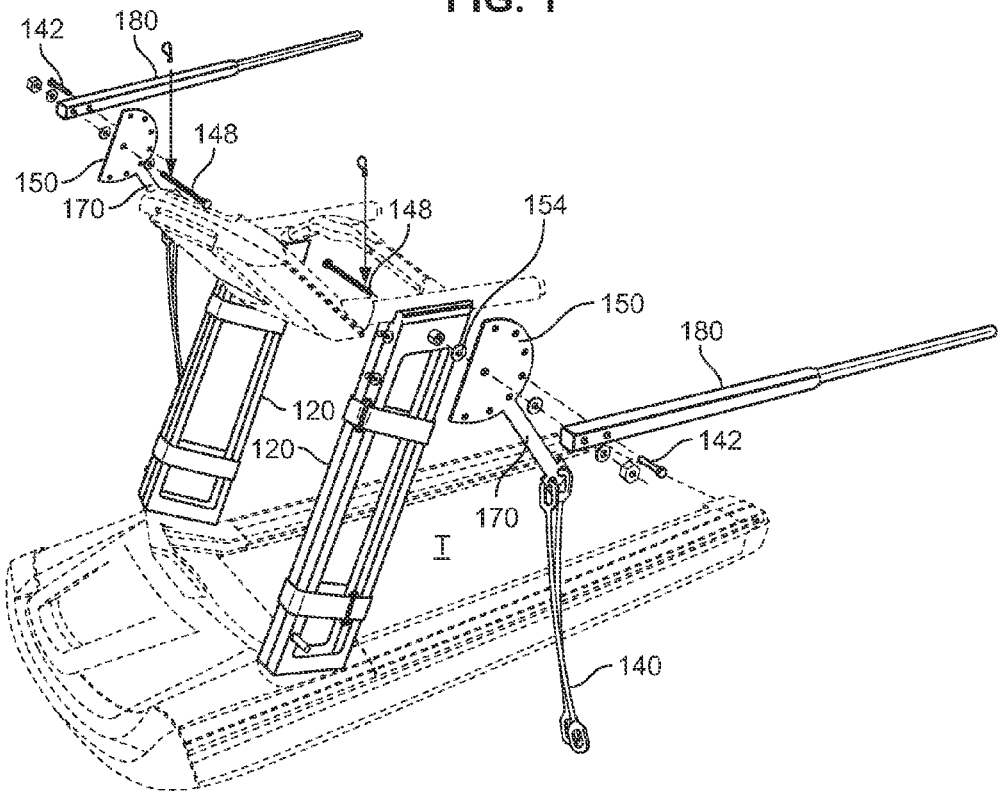
FIG. 2 shows a partially exploded view of a first embodiment of the invention.
Figure 3:
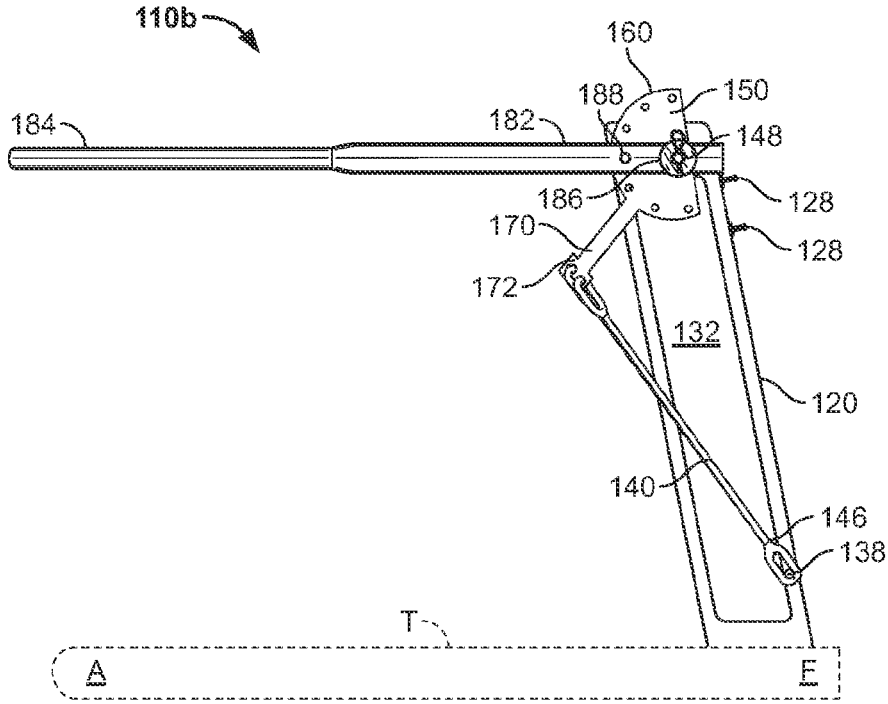
FIG. 3 shows a side view of a first embodiment of the invention.

REFERENCE NUMBERS FOR DRAWINGS
The following list of reference numbers used in the Detailed Description and Drawings is provided for convenience:

| | |
|---|---|
| 100 | First embodiment of a treadmill conversion resistance training apparatus |
| 102 | Mounting Bracket First Piece Interior Surface |
| 103 | Mounting Bracket Second Piece Interior Surface |
| 104 | Mounting Bracket First Piece First Extension |
| 105 | Mounting Bracket First Piece Outer Surface |
| 106 | Mounting Bracket First Piece Second Extension |

-continued

REFERENCE NUMBERS FOR DRAWINGS
The following list of reference numbers used in the Detailed Description and Drawings is provided for convenience:

| | |
|---|---|
| 107 | Mounting Bracket Second Piece Outer Surface |
| 108 | Mounting Bracket Second Piece First Extension |
| 109 | Mounting Bracket Second Piece Second Extension |
| 110 | Resistance Attachment |
| 110a | Left Resistance Attachment |
| 110b | Right Resistance Attachment |
| 112 | Mounting Bracket First Piece Top Edge |
| 114 | Mounting Bracket First Piece Bottom Edge |
| 116 | Mounting Bracket Second Piece Top Edge |
| 118 | Mounting Bracket Second Piece Bottom Edge |
| 120 | Mounting Bracket |
| 122 | Mounting Bracket First Piece |
| 124 | Mounting Bracket Second Piece |
| 126 | Mounting Bracket Slotted Holes |
| 128 | Mounting Bracket Threaded Tighteners |
| 132 | Mounting Bracket Cutout |
| 134 | Translation Member Connection Point |
| 136 | Securing Straps |
| 138 | Resistance Strap Anchor |
| 140 | Resistance Straps |
| 142 | Index Pin |
| 144 | Resistance Strap First End |
| 146 | Resistance Strap Second End |
| 148 | Axle Bolt |
| 150 | Translation Member |
| 151 | Axle Bolt Lock Nut |
| 152 | Central Mounting Hole |
| 154 | Washer |
| 160 | Index Holes |
| 170 | Translation Member Arm |
| 172 | Resistance Strap Connection Points on Lever Arm |
| 180 | Handle |
| 182 | Handle First Connection End |
| 184 | Handle Second Grip End |
| 186 | Handle First Mounting Hole |
| 188 | Handle Second Mounting Hole |
| 200 | Exercise Bench |
| 1000 | Second embodiment of treadmill conversion resistance training apparatus |
| 1010 | Resistance Attachment |
| 1010a | Left Resistance Attachment |
| 1010b | Right Resistance Attachment |
| 1020 | Mounting Bracket |
| 1020a | Left Mounting Bracket |
| 1020b | Right Mounting Bracket |
| 1022 | Mounting Bracket First Part |
| 1024 | Mounting Bracket Second Part |
| 1026 | Mounting Bracket Slotted Holes |
| 1028 | Mounting Bracket Threaded Tightener |
| 1034 | Translation Member Connection Point |
| 1036 | Securing Straps |
| 1038 | Resistance Strap Anchor |
| 1039 | Anchor Mounting Hole |
| 1040 | Resistance Strap |
| 1041 | Resistance Strap Anchor Lock Washer |
| 1042 | Removable Locking Pins |
| 1044 | Resistance Strap First End |
| 1046 | Resistance Strap Second End |
| 1048 | Axle Bolt |
| 1050 | Translation Member |
| 1051 | Axle Bolt Lock Nut |
| 1052 | Translation Member First Plate |
| 1053 | First Plate Center Hole |
| 1054 | Translation Member Second Plate |
| 1055 | Second Plate Center Hole |
| 1056 | Translation Member Spacers |
| 1058 | Translation Member Bolts |
| 1059 | Translation Member Lock Nuts |
| 1060 | First Plate Index Holes |
| 1062 | Second Plate Index Holes |
| 1080 | Handle |
| 1082 | Handle First Part |
| 1084 | Handle First Part Index Hole |
| 1085 | Handle First Part Index Hole |
| 1086 | Handle First Part Mounting Hole |
| 1088 | Handle Second Part |

-continued

REFERENCE NUMBERS FOR DRAWINGS
The following list of reference numbers used in the Detailed Description and Drawings is provided for convenience:

| | |
|---|---|
| 1090 | Handle Joint |
| 1092 | Handle Joint First Plate |
| 1094 | Handle Joint Second Plate |
| 1096 | Handle Joint First Plate Index Holes |
| 1098 | Handle Joint Second Plate Index Holes |
| 1100 | Handle Joint First Plate Center Mounting Hole |
| 1102 | Handle Joint Second Plate Center Mounting Hole |
| 1104 | First Friction Disk |
| 1106 | Second Friction Disk |
| 1108 | Handle Second Part Mounting Hole |
| 1110 | Handle Second Part Index Hole |
| 1112 | Hand Grip |
| 1116 | Handle Joint Axle Bolt |
| 1120 | Flexible Straps |
| T | Exercise Treadmill |
| F | Exercise Treadmill Front End |
| A | Exercise Treadmill Aft End |
| VL | Exercise Treadmill Left Vertical Support |
| VR | Exercise Treadmill Right Vertical Support |
| 2000 | First embodiment of an integral treadmill resistance training apparatus |
| 2002 | Treadmill |
| 2004 | Treadmill forward end |
| 2006 | Treadmill aft end |
| 2008 | Treadmill treadway |
| 2009 | Treadmill control panel |
| 2010a | Left support column |
| 2010b | Right support column |
| 2034a | Left translation axis |
| 2034b | Right translation axis |
| 2038a | Left resistance strap anchor |
| 2038b | Right resistance strap anchor |
| 2040 | Resistance strap |
| 2042 | Locking pin |
| 2050a | Left translation member |
| 2050b | Right translation member |
| 2080a | Left handle |
| 2080b | Right handle |
| 2090a | Left handle joint |
| 2090b | Right handle joint |
| 2130a | Left support column horizontal locking pin |
| 2130b | Right support column horizontal locking pin |
| 2132 | Support column mounting rail |
| 2140a | Left support column sleeve |
| 2140b | Right support column sleeve |
| 2142a | Left sleeve locking pin |
| 2142b | Right sleeve locking pin |
| 3000 | Second embodiment of an integral treadmill resistance training apparatus |
| 3002 | Treadmill |
| 3004 | Treadmill forward end |
| 3006 | Treadmill aft end |
| 3008 | Treadmill treadway |
| 3010a | Left support column |
| 3038a | Left Resistance strap anchor |
| 3040a | Left Resistance strap |
| 3041a | Left Resistance strap |
| 3042 | Locking pins |
| 3050a | Left Translation member |
| 3080a | Left handle |
| 3090a | Left handle articulation joint |
| 3124 | Resistance strap locking pin |
| 3126 | Resistance strap locking pin |
| 3140a | Left support column sleeve |
| 4000 | Third embodiment of an integral treadmill resistance training apparatus |
| 4080 | Articulated handle |
| 4088 | Articulated handle second part |
| 4090 | Articulation joint |
| 4150 | Adjustable grip |
| 4152 | Adjustable grip first portion |
| 4154 | Adjustable grip hand grip portion |
| 4156 | Hand grip portion first length |
| 4158 | Hand grip portion second length |
| 4160 | Locking mechanism |
| 4162 | Locking pin |

-continued

REFERENCE NUMBERS FOR DRAWINGS
The following list of reference numbers used in the Detailed Description and Drawings is provided for convenience:

| | |
|---|---|
| 4164 | Adjustable grip locking holes |
| 4166 | Elongated translational locking hole |

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

For ease of reference a common identification system is used herein for describing the disclosed embodiments. An exercise treadmill as used in this Specification is defined to include a treadway, which the exerciser walks upon during use, a front end, which is the end the exerciser faces when walking forward, and a back end, which is open for the exerciser to enter the treadmill. A "treadmill" also includes the motors and controls associated with an exercise treadmill. Exercise treadmills include variable speed motors which move the treadway and user-accessible controls and safety switches for adjusting the motor speeds. Exercise treadmills often include means for adjusting the angle of the treadway as well. In this regard, reference herein to a "treadmill" or "treadmill means" includes the motors, controls, and safety devices of an exercise treadmill. The invention disclosed includes mirror image left-side and right-side resistance mechanisms. "Mirror-image" includes where the left and right-side components are essentially identical and interchangeable. For clarity, in this Specification, left-side components are described using "a" suffices, right-side components are described using "b" suffices, to indicate their correspondence, and the corresponding left-side and right-side components are referred to collectively without the suffix. For example, referring to FIG. 1, the left-side resistance attachment is identified as 10*a*, the right-side resistance attachment is identified as 10*b*, and the treadmill conversion apparatus as a whole is identified as 10. Subcomponents are referred to without lettering as they are redundant.

An integral treadmill resistance training apparatus includes a treadmill having forward end, an aft end, and a treadway; left and right support columns, each of the support columns including a base portion connected to the treadmill and an upper portion extending upward from the base portion; first and second translation members, each of the first and second translation members rotatingly connected to the left and right support column upper portions, respectively, at a translation axis, each of the translation members including one or more resistance trap connection points radially distal from the translation axis; first and second handles connected to the first and second translation members, respectively; first and second handle locking mechanisms engageable with the first and second translation members and the first and second handles, respectively; and, one or more resistance straps removably connectable between each of the first and second translation members and the left and right support columns, respectively. An integral treadmill resistance training apparatus may include, wherein each of the first and second handles includes an articulation joint and an articulation joint locking mechanism engageable at selected angles. An integral treadmill resistance training apparatus may include, wherein the articulation joint includes an adjustable rotational resistance mechanism. An integral treadmill resistance training apparatus may include, wherein each of the one or more resistance straps removably connectable between each of the first and second translation members and the left and right support columns, respectively, comprises a plurality of resistance straps connected in opposing orientation, such that resistance is created when rotating the translation member in either the clockwise or counter-clockwise directions. An integral treadmill resistance training apparatus may include first and second resistance strap pre-tensioners. An integral treadmill resistance training apparatus may include wherein the left and right support column base portions are adjustably connected to the treadmill so as to vary the lateral separation between the left and right support columns. An integral treadmill resistance training apparatus may include, further comprising: wherein each of the left and right support column upper portions includes a sleeve adjustably mounted to the support column, and wherein each of the translation members connects to a respective right or left support column sleeve. An integral treadmill resistance training apparatus may include first and second adjustable grips, each of the adjustable grips including a first portion rotatably and slidingly connected to the first and second handles, respectively, a hand grip portion extending from and offset from the first portion, and a locking mechanism releasably engageable with the first portion and the handle.

An integral treadmill resistance training apparatus, includes a treadmill having a forward end, an aft end, and a treadway; left and right support columns, each of the support ns including a base portion connected to the treadmill and an upper portion extending upward from the base portion; first and second translation members rotatingly attached to the left and right column upper portions, respectively; first and second articulated handles connected to the first and second translation members, respectively, each of the handles having a first part and a second part and a joint connecting the first and second parts, wherein each of the handle first parts is further connectable to the respective translation member at an adjustable angle to the translation member, and wherein each of the joints includes a locking mechanism engageable with the joint and the handle second part at selectable angles to the handle first part, and wherein each of the handle second parts further includes a hand grip; and, a plurality of resistance straps connectable between the translation members and the support columns. An integral treadmill resistance training apparatus may include herein of the first and second handle joints further includes adjustable rotational resistance mechanism. An integral treadmill resistance training apparatus may include, wherein each of the articulated handle joint adjustable rotational resistance mechanism comprises one or more friction disks. An integral treadmill resistance training apparatus may include, wherein each of the one or more resistance straps removably connectable between each of the first and second translation members and the left and right support columns, respectively, comprises a plurality of resistance straps connected in opposing orientation, such that resistance is created when rotating the translation member in either the clockwise or counter-clockwise directions. An integral treadmill resistance training apparatus may include, first and second resistance strap pre-tensioners.

An integral treadmill resistance training apparatus may include, wherein the left and right support column base portions are adjustably connected to the treadmill so as to vary the lateral separation between the left and right support columns. An integral treadmill resistance training apparatus may include, wherein each of the left and right support column upper portions includes a sleeve adjustably mounted to the support column, and wherein each of the translation members connects to a respective right or left support column sleeve. An integral treadmill resistance training apparatus may include, first and second adjustable grips, each of the adjustable grips including a first portion rotatably and slidingly connected to the first and second handle second parts, respectively, a hand grip portion extending from and offset from the adjustable grip first portion, and a locking mechanism releasably engageable with the adjustable grip first portion and the handle second portion.

An integral treadmill resistance training apparatus includes a treadmill having a forward end, an aft end, and a treadway; left and right support columns, each of the support columns including a base portion connected to the treadmill and an upper portion extending upward from the base portion; first and second resistance strap bottom anchors projecting outwardly from the left and right support lumns, respectively; first and second translation members rotatingly connected to the right and left support column upper portions, respectively, each of the translation members comprising: a central mounting hole, a plurality of handle indexing holes distributed radially around the central mounting hole at selected angular offsets, and one or more resistance strap connection points radially distal from the central mounting hole; first and second handles adjustably connected to the first and second translation members, respectively, each of the handles comprising: an elongated shaft extending from a first connection end to a second grip end, a first handle mounting hole disposed proximal to the handle connection end, a second handle mounting hole disposed distally from the first handle mounting hole toward the handle grip end, wherein the distance between the first and second handle mounting holes matches the radial distance between the center mounting hole and the plurality of handle index holes of the translation member, and further wherein a portion of the handle near the second end includes a hand grip; a first axle rotatingly connecting the first handle and the first translation member to the left support column, and a second axle rotatingly connecting the second handle and the second translation member to the right support column; first and second handle index pins removably engageable with the first and second handles and the first and second translation members, respectively, through the handle second mounting hole and a selected handle index hole; and, a plurality of resistance straps, each of the resistance straps connectable at a first end to a resistance strap anchor and at a second end to a translation member connection point.

An integral treadmill resistance training apparatus may include, wherein each of the first and second axles comprises: an axle post extending outwardly from the support column, the axle post having an axial center through-hole, a rotational bearing mounted to the axle post, a center bolt, and a center bolt retaining nut; wherein each of the translation members is rotatingly attached to the respective axle post over the bearing, thereby engaging the bearing, and the center bolt extends through the center through hole and the handle first mounting hole and engages the center bolt retaining nut. An integral treadmill resistance training apparatus may include, further comprising: wherein the left and right support column base portions are adjustably connected to the treadmill so as to vary the lateral separation between the left and right support columns. An integral treadmill resistance training apparatus may include, wherein each of the left and right support column upper portions includes a sleeve adjustably mounted to the support column, and wherein each of the translation members connects to a respective right or left support column sleeve and further wherein each of the first and second bottom anchors projects from the left and right support column sleeves, respectively.

Referring to FIGS. 1-5, in a first embodiment a treadmill conversion resistance training apparatus 100 is provided fora treadmill T having left and right support columns VL and VR, respectively, a forward and F and an aft end A. Treadmill conversion apparatus 100 includes mirror-image left and right attachments 110*a* and 110*b*, respectively, for attaching to the treadmill left and right support columns VL and VR. Each of the resistance attachments 110*a* and 110*b* has a vertical mounting bracket 120*a* and 120*b* removably attachable to treadmill support columns VL and VR. Resistance attachments 110*a* and 110*b* are mirror images of each other and include redundant components, so will be described generically.

Referring again to FIGS. 1-5, in a first embodiment a resistance attachment 110 includes a vertical mounting bracket 120, a translation member 150 rotatingly connectable to vertical mounting bracket 120 at a connection point 134. Vertical mounting bracket 120 includes opposing first and second bracket pieces 122 and a piece 124 for mounting around support columns VL and VR. Each of first and second bracket pieces 122 and 124 have a top edge 112 and 116, respectively, and a bottom edge 114 and 118, respectively. Each of mounting bracket pieces 122 and 124 includes cutouts 132 to reduce weight. Mounting bracket pieces 122 and 124 are generally U-shaped in cross section with first extensions 104 and 108, respectively, and second extensions 106 and 109, respectively, creating interior surfaces 102 and 103, respectively, and outer surfaces 105 and 107, respectively. At least one, clamping bolt 128 is provided which engages mounting bracket first piece 122 through slotted hole 126 in mounting bracket second piece extension 104. In the embodiment two clamping bolts each are provided at the forward and aft of each vertical mounting brackets 120. Retaining straps 136 are provided to help assemble and stabilize mounting brackets 120. Anchor 138 extends outwardly from the outer surface 105 of mounting bracket first piece 122 proximal to bottom edge 114. In the embodiment anchor 138 is a fixed threaded post.

Connection point 134 extending outwardly from mounting bracket first piece 122 and located proximal to top edge 112, receives axle bolt 148 defining a translation axis about which translation member 150 and handle 180 rotate. In the disclosed embodiment connection point 134 is a short cylinder welded to mounting bracket first part 122. Translation member 150 has connector 172 for removably connecting one or more resistance straps 140. Handle 180 is connectable to translation member 150. In the embodiment handle 180 is an elongated shaft having first end 182 and second end 184. Handle second end 184 provides a hand grip. Handle 180 has a first mounting hole 186 for removably connecting to translation member 150 by receiving axle bolt 148 there through and a second mounting hole 188 for receiving an index locking pin 142 there through. In the disclosed embodiment lock nut 151 retains handle 180 and translation member 150. Washer 154 is provided between translation member 150 and connection point 134. Alternatively washer 154 may be replaced by a rotational bearing mounted onto connection point 134. Axle bolt 148 may be removable or alternatively a fixed axle. Handle 180 may be articulated.

Handle 180 can be locked at an adjustable angular orientation in relation to the translation member 150, such that moving the locked handle 180 causes the translation member 150 to rotate about the translation axis 134. In the osed embodiment translation member 150 includes a plurality of index holes 160 disposed radially about central mounting hole 152 at pre-selected angular offsets. The distance between handle first mounting hole 186 and handle second mounting hole 188 is equal to the distance between center mounting hole 152 and index holes 160. Receiving hooks 172 are provided for removably connecting one or more resistance straps 140 to translation member 150 at a point radially distant from center mounting hole 152. Translation arm 170 extends radially outward from translation member 150 to provide a connection point with a greater range of motion while maintaining translation member 150 relatively compact.

One or more resistance straps 140 removably connectable between the translation member 150 and the vertical mounting bracket 120. Each of resistance straps 140 include a first end 144 connectable to receiving hook 172 and a second end 146 connectable at anchor 138. Resistance straps 140 provide incremental resistance for exercises, with the user selecting the number and type cif resistance straps 140 depending on their ability and desired intensity of their workout.

Figure 4:
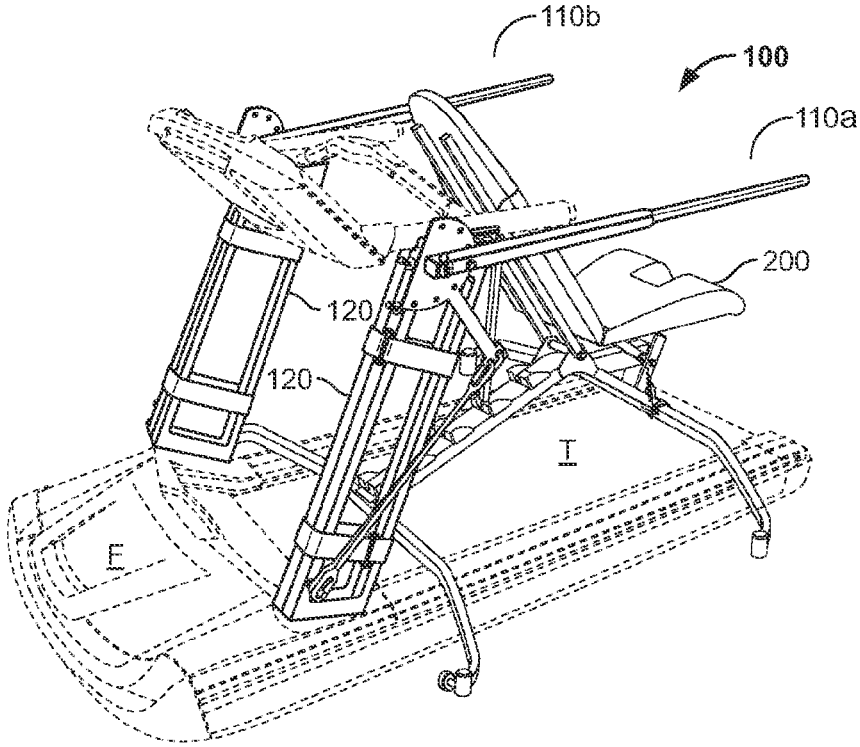
FIG. 4 shows front perspective view of a first embodiment of the invention with an articulated bench.
Figure 5:
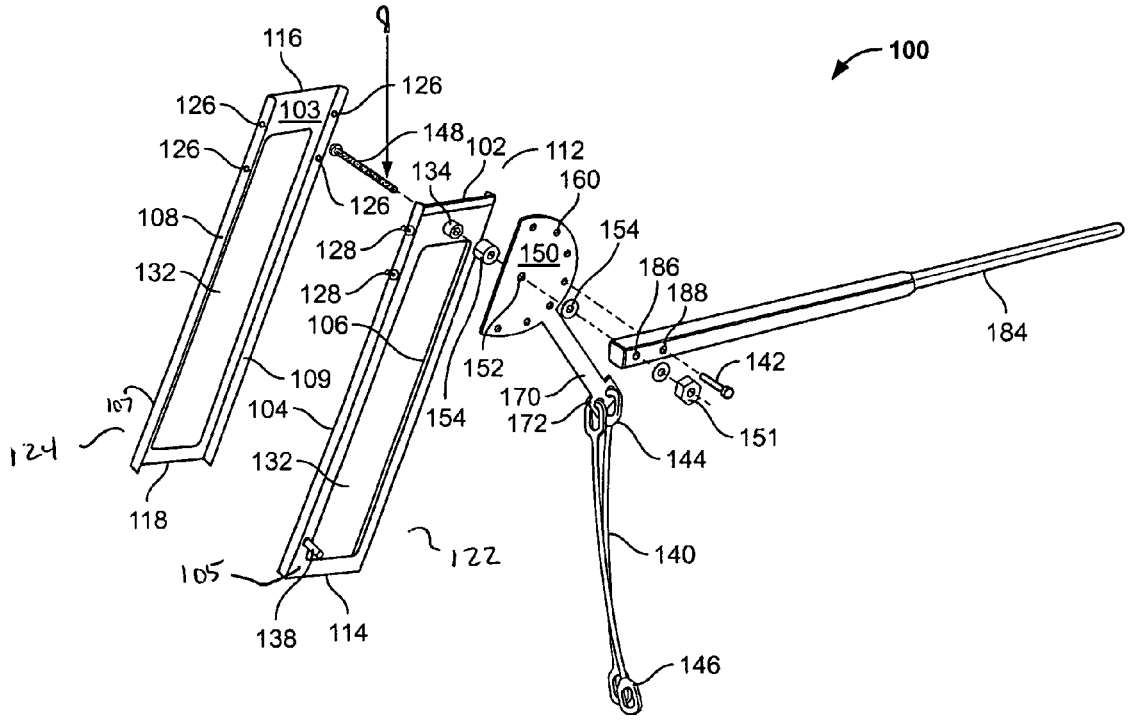
FIG. 5 shows an exploded view of a resistance attachment of a first embodiment of the invention.

Referring to FIG. 4, a treadmill conversion apparatus may include an exercise bench 200 which fits over treadmill T treadway, to allow for exercising from the supine or sitting positions. Alternatively, a user could simply lay or sit on the treadway.

Treadmill conversion apparatus 100 allows the exercise treadmill T to continue to function as an exercise treadmill while the apparatus 100 is attached to the exercise treadmill T.

Referring to FIGS. 6-9, a second embodiment of a system 1000 for converting an exercise treadmill T for strength training, is shown, having a forward end F, and aft end A, and left and right support columns VL and VR, respectively, and includes left and right attachments, 1010*a* and 1010*b*, respectively, where each attachment 1010*a* and 1010*b* has a mounting bracket 1020*a* and 1020*b*, respectively, removably attachable to a support column VR or VL. Mounting brackets 1020*a* and 1020*b* are mirror images of each other and each may be attachable to either support column VR or VL, depending on the configuration preferred by the user. In the disclosed embodiment, mounting brackets 1020*a* and 1020*b* are attached with bracket 1020*a* attached to left column VL and 1020*b* attached to right column VR, for inside mounting of translation members 1050. Alternatively, for a treadmill T with a more narrow spacing of support columns, mounting bracket 1020*a* may be mounted to right column VR and mounting bracket 1020*b* may be mounted to left column VL, to provide outside mounting of translation members 1050. While mounting brackets 1020*a* and 1020*b* are mirror images, all other components in the disclosed embodiment are interchangeable on the left and right sides, and so only one attachment 1010 is shown in detail for explanation in FIGS. 7-9.

Referring to FIGS. 6, and FIGS. 7-9, an attachment 1010 includes a vertical mounting bracket 1020 removably attachable to a treadmill support column VL or VR, a translation member 1050 rotatingly connectable to a mounting bracket 1020, articulated handle 1080 connectable to translation member 1050, and one or more resistance straps 1040 connectable between mounting bracket 1020 and translation member 1050.

Figure 6:
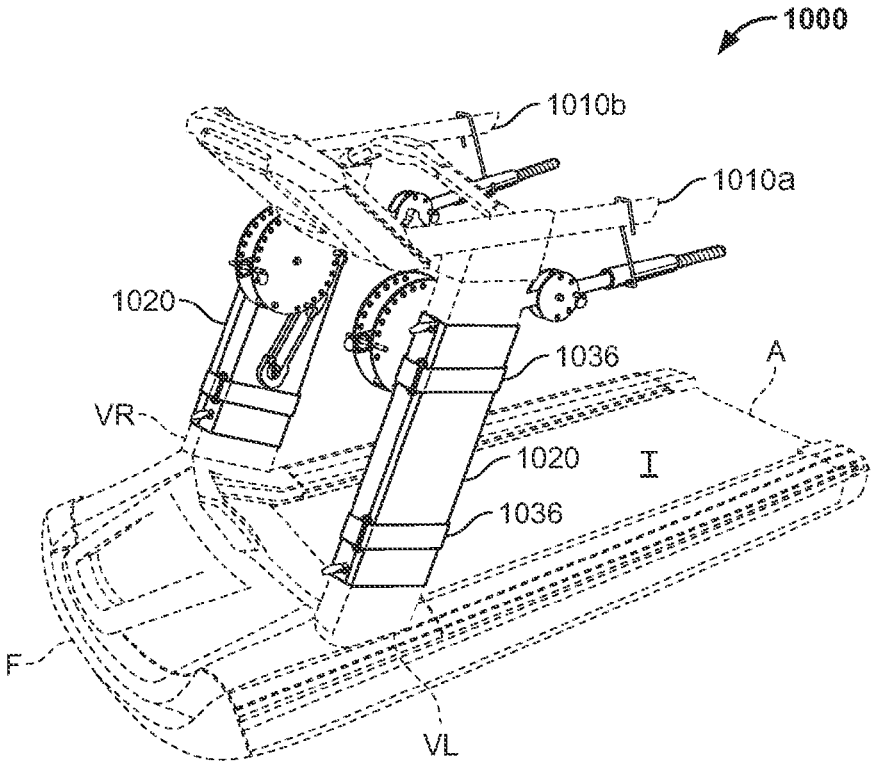
FIG. 6 shows a front perspective view of a second embodiment of the invention.
Figure 7:
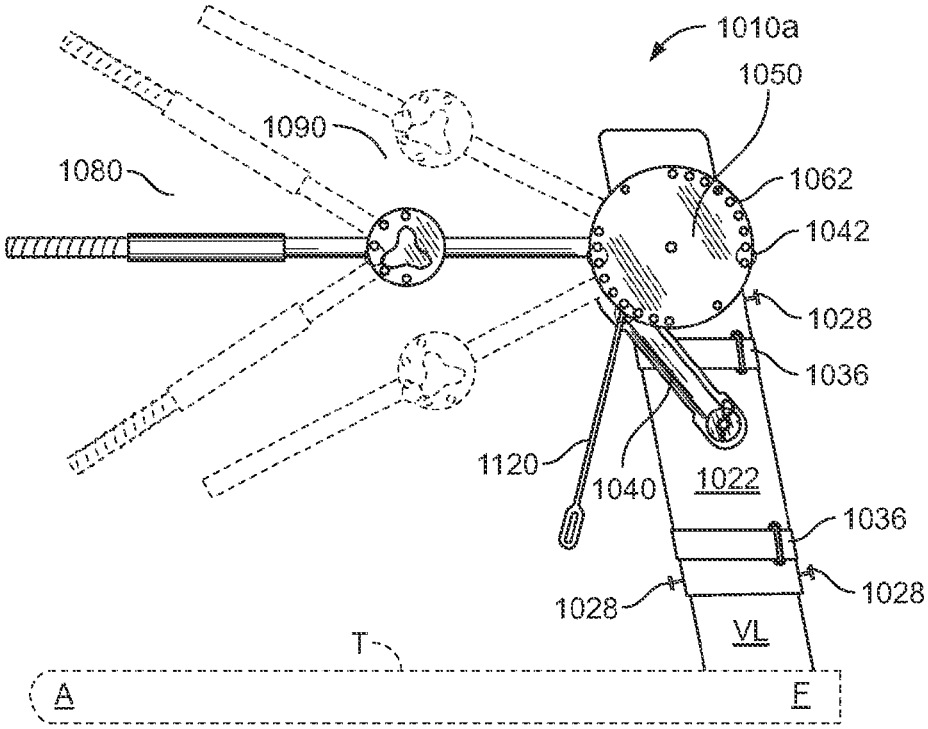
FIG. 7 shows a side cut-away view of a second embodiment of the invention, indicating the nature of movement.
Figure 8:
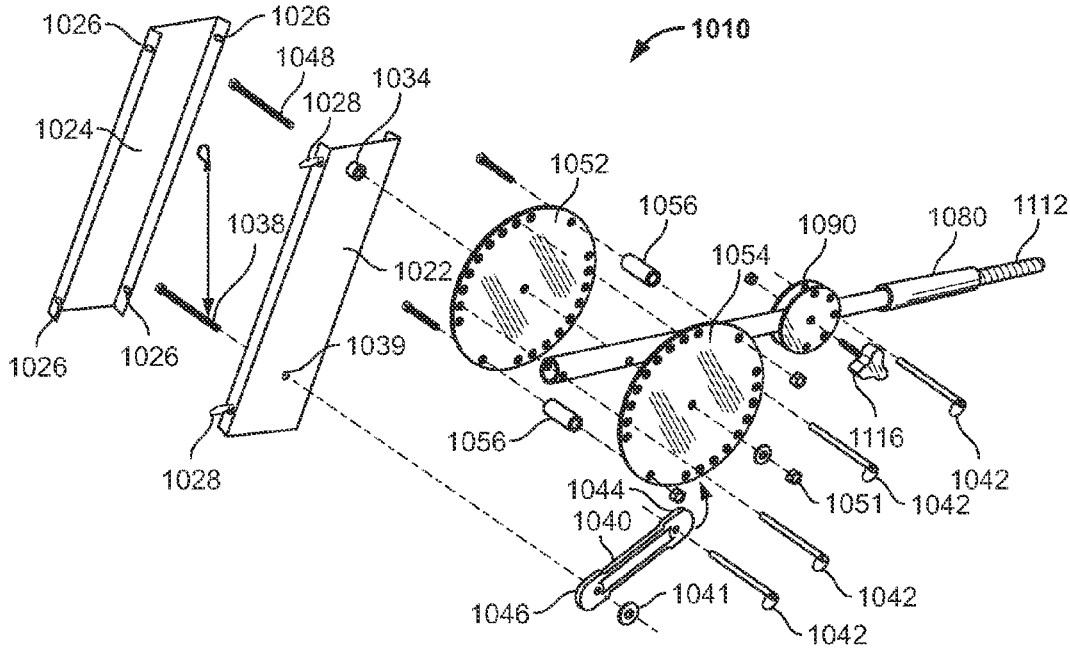
FIG. 8 shows an exploded view of a resistance attachment of a second embodiment of the invention.

Referring to FIGS. 6-8, mounting bracket 1020 includes a first part 1022 matable to a second part 1024 about a treadmill support column VR or VL. Threaded tighteners 1028 extend through slotted holes 1026 in second part 1024 to engage threaded receiving holes on first part 1022 in order to secure mounting bracket 1020 around a support column VR or VL. Mounting bracket 1020 may include additional threaded tighteners 1028 on the opposing side as well. Referring to FIGS. 6 and 7, adjustable securing straps 1036 are provided to assist in securing vertical mounting brackets 1020*a* and 1020*b* to treadmill support columns VR and VL. In the embodiment two adjustable securing straps 1036 are provided for each mounting bracket 1020*a* & *b*, one for top and one for bottom.

Referring again to FIG. 8, mounting bracket 1020 includes a connection point 1034 for rotatably and removably connecting translation member 1050. axle bolt 1048 extends through connection point 1034 and translation member 1050 to provide the axis of rotation for translation member 1050, and is secured using a retaining nut and washer set 1051. Alternatively, axle bolt 1048 may be a fixed threaded axle. A rotational bearing for engaging translation member 1050 may be mounted over connection point 1034 or axle bolt 1048 to reduce friction and assist in distributing torque loads. Mounting bracket 1020 includes anchor 1038 with locking pin and washer 1041 for connecting resistance straps 1040 to mounting bracket 1020. In the embodiment axle bolt 1048 and anchor 1038 are mounted from the inside of mounting bracket 1020 oriented outward, so that a user does not have to drill through treadmill support columns VR and VL to attach the vertical mounting bracket 1020. Alternatively, anchor 1038 may be a fixed bolt or post.

Figure 9:
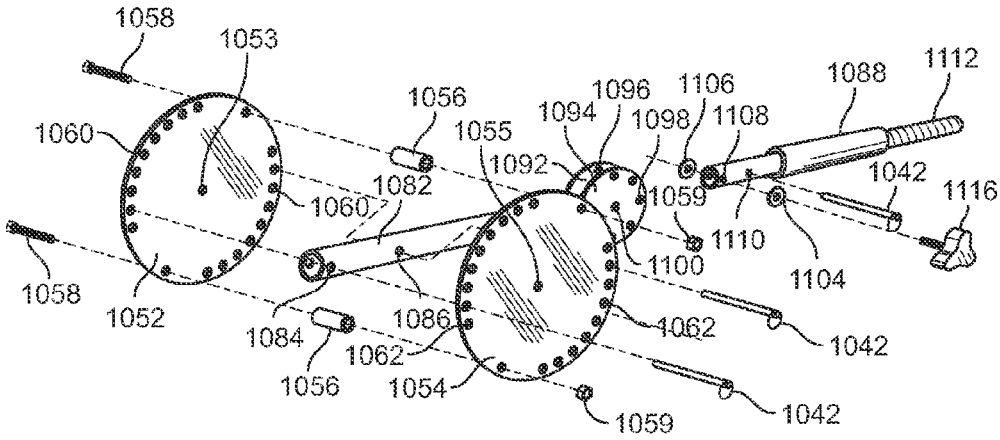
FIG. 9 shows an exploded view of a translation member and articulated handle of a second embodiment of the invention.

Referring to FIGS. 8 and 9, translation member 1050 includes opposing first and second plates 1052 and 1054, respectively, which are bolted together via spacers 1056 and bolts 1058 with retaining nuts 1059. Matching index holes 1060 and 1062 are distributed radially about center mounting holes 1053 and 1055 for locking articulated handle 1080 at the desired angular orientation to translation member 1050 using a pair of locking pins 1042.

Articulated handle 1080 includes a first part 1082 connectable to translation member 1050 at a selected angular orientation to translation member 1050 and a second part 1088 rotatingly connected to handle first part 1082 at joint 1090. Handle first part 1082 includes handle first part mounting hole 1086 for receiving axle bolt 1048, and handle first part indexing holes 1084 and 1085 for receiving removable locking pins 1042 when aligned with index holes 1060 and 1062. Joint 1090 includes first and second joint plates 1092 and 1094, respectively, fixed on opposing sides of hand first part 1082 and having matching joint index holes 1096 and 1098 and center mounting holes 1100 and 1102 (1102 not visible in the views), and first and second friction disks 1104 and 1106. Handle second part 1088 has a mounting hole 1108, index hole 1110 and hand grip 1112. When assembled, handle second part 1088 fits between first and second joint plates 1092 and 1094. First and second friction disks 1104 and 1106 fit into the spaces between handle second part 1088 and first and second joint plates 1092 and 1094. Handle second part mounting hole 1108 and friction disks 1104 and 1106 align with joint plate center mounting holes 1100 and 1102 to receive joint axle bolt 1116. In the embodiment joint axle bolt 1116 includes a knurled or petal-shaped handle grip for ease of use. An index locking pin 1042 is provided to engage joint index holes 1096 and 1098 with handle second part index hole 1110, thereby allowing handle second part 1088 to be locked in a desired angular orientation to handle first part 1082. Alternatively, with index pin 1042 removed, handle second part 1088 may be rotated about joint 1090 for exercise, with friction resistance provided by friction disks 1104 and 1106. In the embodiment friction disks 1104 and 1106 are made from plastic material such as nylon for ease of manufacture and minimal expense, as they will wear over time, but any suitable material may be used.

One or more resistance straps 1040 are provided for connecting between mounting bracket 1020 and translation member 1050. Resistance strap 1040 connects at a first end 1046 to mounting bracket 1020 via anchor 1038 and at a second end 1044 to translation member 1050 using a locking pin 1042 through translation member index holes 1060 and 1062. In the embodiment resistance strap 1040 is made from a strong stretchable material such as butyl rubber, but other stretchable materials such as silicone rubber or other suitable materials could be used. Additionally, flexible straps 1120 may be attached to translation member 1050 using a locking pin through index holes 1060 and 1062 in order to increase the range of exercises available. In the disclosed embodiment flexible straps 1120 are bungee cords or surgical tubing.

Referring to FIGS. 6-9, in operation the second embodiment of a treadmill conversion resistance training apparatus, a user begins by assembling and mounting the conversion apparatus to a treadmill. Assembly involves inserting axle bolt 1048 and anchor 1038 through connection point 1034 and hole 1039 (if not permanently mounted), respectively, then mounting the attachments 1010*a* and 1010*b* around respective treadmill support columns VR and VL by sandwiching first and second mounting bracket parts 1022 and 1024 around each of support columns VR and VL, tightening adjustable securing straps 1036 to hold them tightly, and threading locking handles 1028 through slotted holes 1026 to lock first and second parts 1022 and 1024 in place. Articulated handle 1080 is inserted into translation member 1050 and aligned at a desired angle, and locking pins 1042 are inserted through index holes 1060, 1062, 1084 and 1085. Translation member 1050, with handle 1080 mounted therein, is attached to connection point 1034 using axle bolt 1048 and retaining nut and washer 1051. Retaining nut and washer 1051 lock to prevent backing off axle bolt 1048, but do not lock translation member 1050 from rotation. Translation member 1050 is free to rotate about axle bolt 1048.

Resistance strap 1040 is connected at first end 1044 using anchor 1038, and at a second end 1046 to translation member 1050 using a locking pin 1042. Resistance strap 1040 may be connected at any of the indexing holes 1060 and 1062, thereby allowing a user to accommodate straps of differing length. The user may also selectively adjust the angle of handle 1080 by selecting different index holes 1060 and 1062, to accommodate different user heights or different ranges of motion. Use of additional resistance straps 1040 allows incremental increase in resistance and therefore the intensity of exercises. Attaching resistance strips 1040 to translation member 1050 at a radial distance from axle bolt 1048 provides a smooth, essentially linear resistance profile. Resistance strap 1040 could also be attached to handle 1080 and function adequately.

Articulated handle joint 1090 allows a user to lock handle 1080 at a selected angle in order to utilize resistance straps 1040 for exercise, or to unlock handle joint handle joint 1090 and use handle 1080 for resistance exercising. Resistance of handle joint 1090 to rotation is adjustable by adjusting the tightness of joint axle bolt 1116—i.e. tightening joint axle bolt 1116 compresses joint plates 1092 and 1094 against friction disks 1104 and 1106, thereby increasing resistance, while looseing joint axle bolt 1116 reduces resistance.

A user may utilize articulated bench 200, shown in FIG. 4, placed over treadway Tin order to perform bench presses, shoulder presses, and other traditional strength exercises from a supine, prone, or sitting position. Alternatively, a user could lay a pad directly on treadway T and lie or sit on the pad to perform exercises.

Referring to FIG. 7, the nature of movement of the translation member 1050 and articulated handle joint 1090 are shown by hidden lines. Varying the angle of handle 1080, and/or the connection point of resistance strap 1040 to translation member 1050, and/or the model of resistance strap 1040, and/or the angle of joint 1090, and/or the rotational resistance of joint 1090, allows the treadmill resistance training apparatus to accommodate a wide range of user heights, abilities, and exercises of various ranges of motion and resistance profiles.

The treadmill resistance training apparatus 1000 is easily removable by reversing the attachment steps described above. A user may choose to simply leave the resistance training apparatus attached, as the apparatus does not interfere with the normal operation of the treadmill.

Figure 10:
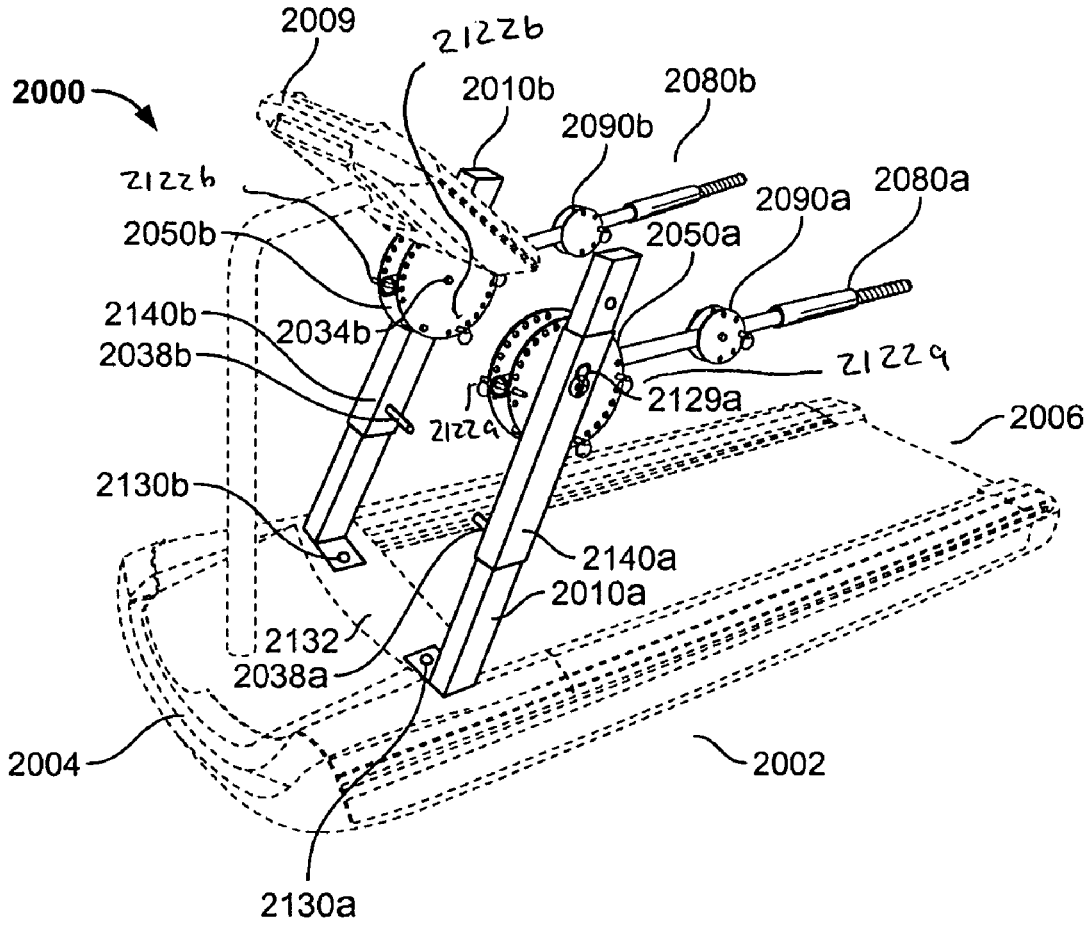
FIG. 10 shows a front perspective view of an embodiment of an integral treadmill resistance trailing apparatus.

Referring to FIG. 10, an integral treadmill resistance training apparatus 2000 is shown, including treadmill 2002 having forward and 2004, an aft end 2006, a treadway 2008, and left and right support columns 2010*a* and 2010*b*; first and second translation members 2050*a* and 2050*b*, each of first and second translation members 2050*a* & *b* rotatingly connected to left and right support columns 2010*a* & *b*, respectively, at translation axes 2034*a* and 2034*b*, each of the translation members having locking pins 2042*a* and 2042*b* for removably connecting one or more resistance straps (not shown) at one or more locations; first and second handles 2080*a* and 2080*b* connected to the first and second translation members 2050*a* & *b*, respectively; locking pins 2122*a* and 2122*b* for locking each of the first and second handles 2080*a* & *b* at an adjustable angular orientation in relation to the first and second translation members 2050*a* & *b*, respectively, such that moving the locked handles 2080*a* and *b* causes the respective translation members 2050*a* & *b* to rotate about the respective translation axes; and, one or more resistance straps removably connectable between each of the first and second translation members 2050*a* & *b* and the left and right support columns 2010*a* & *b*, respectively, Control panel 2009 provides controls for treadmill 2002.

As shown in FIG. 10, the separation distance between first and second translation members 2050*a* & *b* is adjustable to accommodate users of different sizes and to concentrate on different muscle groups. In the embodiment the separation distance is adjusted by moving support columns 2010*a* & *b* closer together or farther apart, by removing locking pins 2130*a* & *b* and sliding support columns 2010*a* & *b* toward or away from each other along mounting rail 2132, and reinserting locking pins 2130*a* & *b*. In the embodiment support columns 2010*a* & *b* are slidably mounted around a rail to facilitate adjustment.

As shown in FIG. 10, the height of first and second translation members 2050*a* & bin relation to treadway 2008 is adjustable to accommodate users of different heights and to adjust between standing use and prone use. In the embodiment adjustment is provided by connecting translation members 2050*a* & *b* to sleeves 2140*a* and 2140*b*, which sleeves 2140*a* & *b* are slidably connected to support columns 2010*a* & *b*, respectively. Sleeves 2140*a* & *b* are locked in place using locking pins 2142*a* & *b*, respectively. Anchors 2038*a* and 2038*b* project from sleeves 2140*a* & *b*, respectively, so that height adjustment will not affect the tension of resistance straps (not shown) connectable between anchors 2038*a* & *b* and translation members 2050*a* & *b*. Handles 2080*a* & *b* are indexable, articulated, lockable handles with adjustable rotating resistance at joints 2090*a* & *b*.

Figure 11:
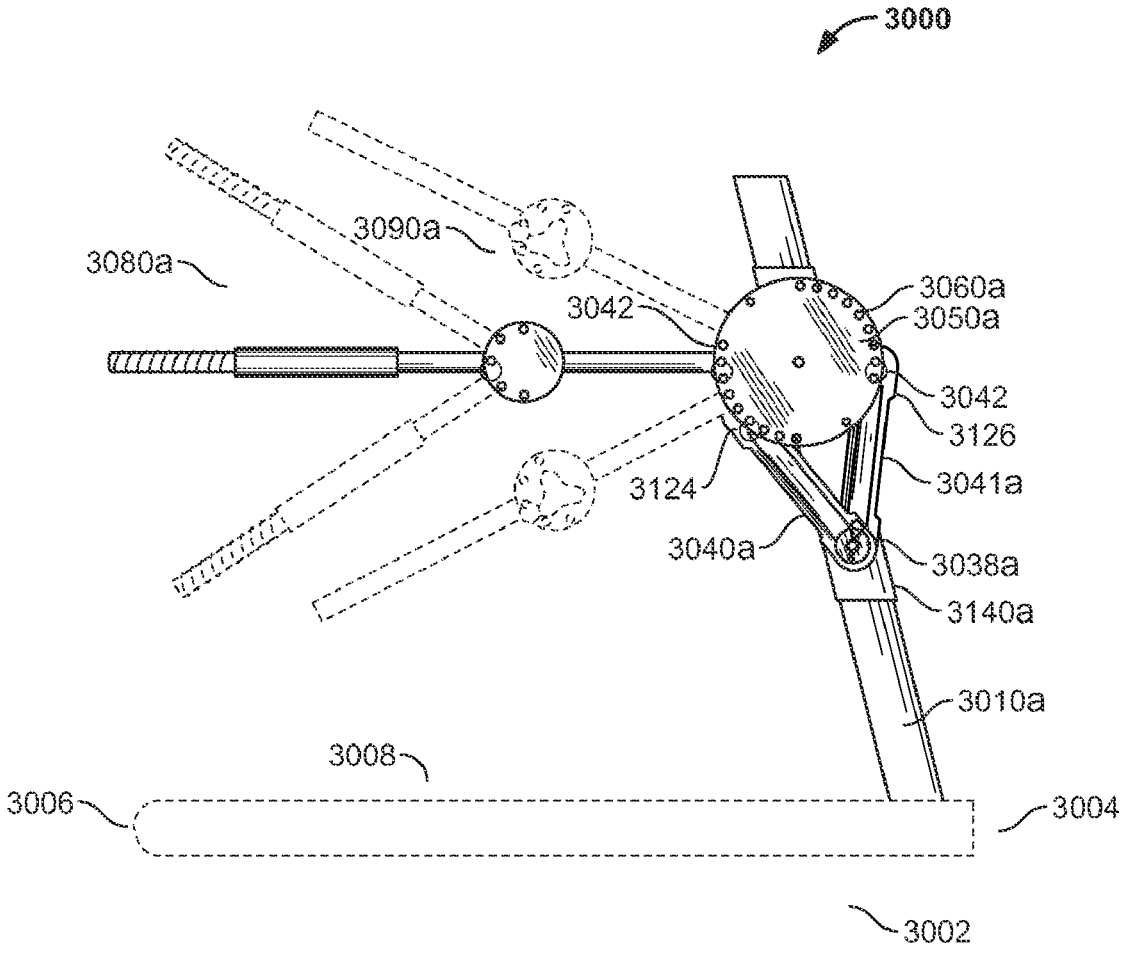
FIG. 11 shows a cut-away left side profile of another embodiment of an integral treadmill resistance training apparatus.

Referring to FIG. 11, a second embodiment of an integral treadmill resistance training apparatus 3000 is shown in profile cut-away view showing only a left-side of the apparatus 3000, including a treadmill 3002 having forward end 3004, aft end 3006 and treadway 3008. Left support column 3010*a* extends upward from the treadmill 3002. Left support column sleeve 3140*a* provides vertical adjustment of left translation member 3050*a*. The opposing right-side of apparatus 3000 is a mirror image. As shown in FIG. 11 each side of apparatus 3000 includes one or more resistance straps 3040*a* removably connectable between anchors 3038*a* and the respective translation member 3050*a* in a rearward orientation, and one or more resistance straps 3041*a* removably connectable between anchors 3038*a* and the respective translation member 3050*a* in an opposing forward orientation. In this way, if translation member 3050*a* is rotated clockwise (i.e. the user lifts or pushes handle 3080*a* upward) then resistance strap 3040*a* provides resistance, and if translation member 3050*a* is rotated counter-clockwise (i.e. the user depresses or pushes handle 3080*b* downward) then resistance strap 3041*a* provides resistance. In the embodiment resistance straps 3040*a* and 3041*a* are thin flexible straps or chords so as to not provide resistance in compression. Resistance strap 3040*a* is removably connected at a first end to anchor 3038*a* and at a second end to translation member 3050*a* using locking pin 3124. Resistance strap 3041*a* is removably connected at a first end to anchor 3038*a* and at a second end to translation member 3050*a* using locking pin 3126. Handle 3080*a* includes locking, indexable, variable resistance articulation joint 3090*a*. Handle 3080*a* is locked in a selected indexed position in relation to translation member 3050*a* using locking pins 3042 inserted through translation member indexing holes 3060*a*.

As shown in FIG. 11, resistance straps may be pre-tensioned. Pre-tensioning allows resistance straps to be connected more easily in a non-tensioned condition, and then pre-tensioned prior to use to provide continuous resistance throughout the range of motion. In the embodiment pretensioning is provided by making anchors 3038*a* (and 3038*b*, not shown) adjustable.

Figure 12:
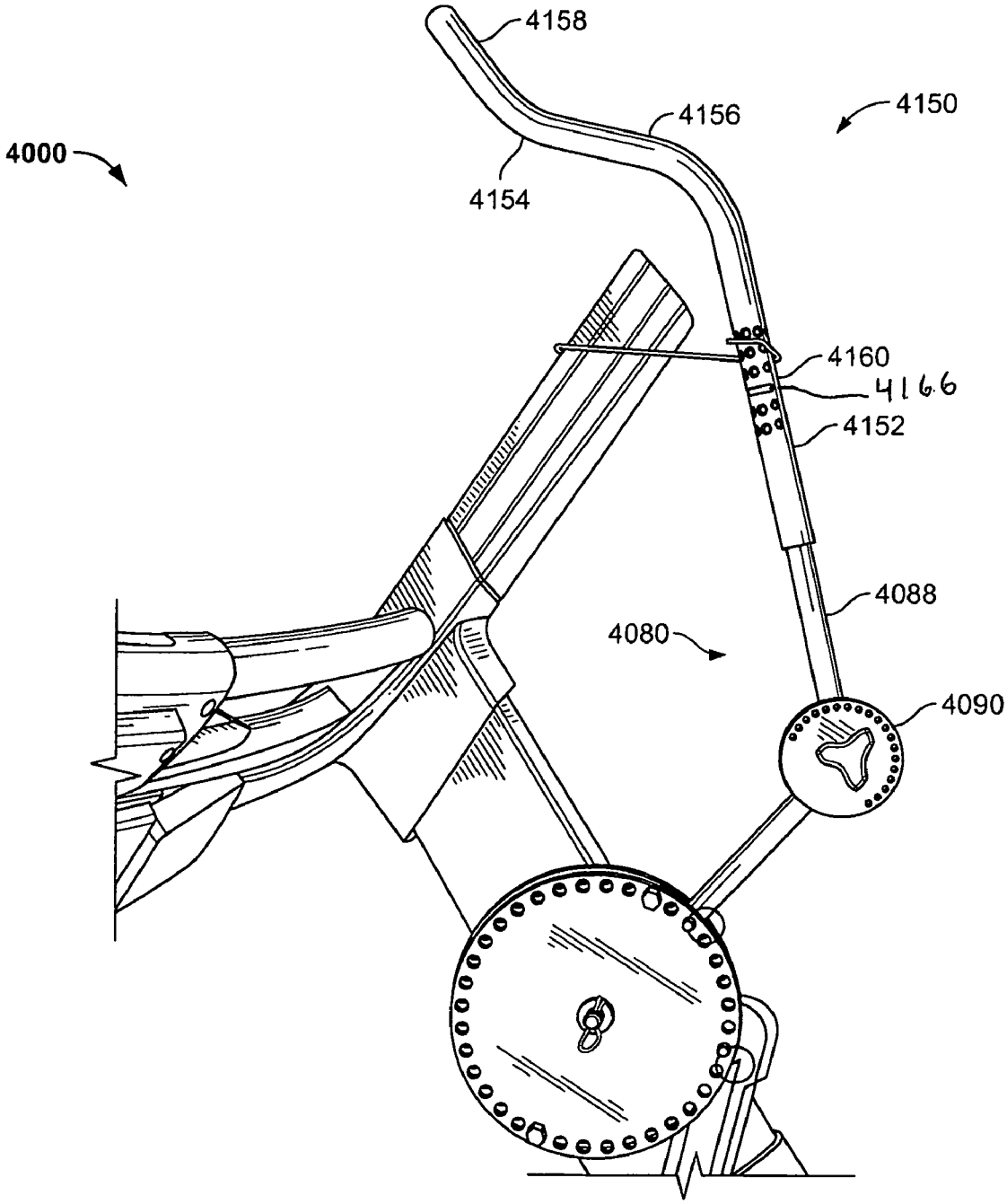
FIG. 12 shows a an embodiment having an adjustable grip.
Figure 13:
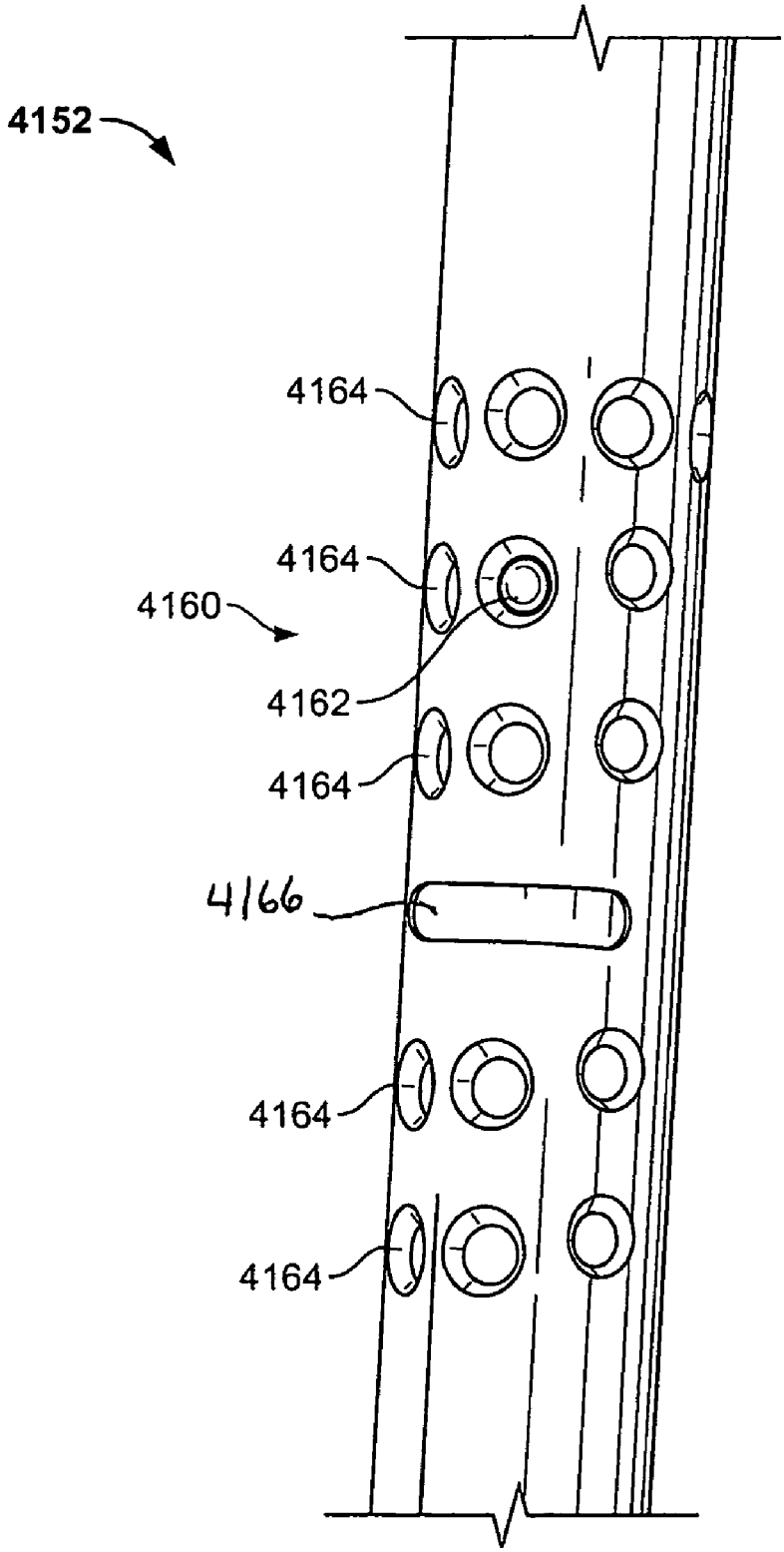
FIG. 13 shows a close-up view of an adjustable grip.

Referring to FIGS. 12 & 13, and embodiment 4000 is shown having adjustable grips 4150. Only the right-hand adjustable grip 4150 is shown for illustration as the left-hand adjustable grip is identical in the disclosed embodiment. Articulated handle 4080 includes a handle second part 4088 connected to handle joint 4090. Adjustable grip 4150 includes a first portion 4152 connected to handle second part 4088, and a hand grip portion 4154 extending from first portion 4152. In the embodiment, hand grip portion 4154 includes a first length 4156 extending from first portion 4152 at an obtuse angle and a second length 4158 continuing substantially parallel to first portion 4152, so that hand grip portion 4154 provides an offset grip ability. A user may also grip either the first length 4156 or the second length 4158 depending on the exercise in order to adjust wrist rotation angle. In the embodiment, first portion 4152 fits over handle second part 4088 like a sleeve so a user may slide it linearly to adjust the effective handle length, or rotate about the axis of handle second part 4088 to adjust the angle and orientation of grip. Selective linear and rotational adjustment is provided by locking mechanism 4160 which releasably engages adjustable grip first portion 4152 with handle second portion 4088. In the embodiment, locking mechanism 4160 includes a spring-loaded locking pin 4162 selectively engageable with grip fixed locking holes 4164, or with elongated translational locking hole 4166 to permit partial rotation of the adjustable grips about the handle axes.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

We claim:

1. An integral treadmill resistance training apparatus, comprising, a treadmill having forward end, an aft end, and a treadway left and right support columns, each of said support columns including a base portion connected to said treadmill and an upper portion extending upward from said base portion;

first and second translation members, each of said first and second translation members rotatingly connected to said left and right support column upper portions, respectively, at a translation axis, each of said translation members including one or more resistance strap connection points disposed radially distal from said translation axis;

first and second handles connected to said first and second translation members proximate a first end and extending to a hand grip proximate a second end, respectively;

first and second handle locking mechanisms engageable with said first and second translation members and said first and second handles, respectively; and, one or more resistance traps removably connectable between each of said first and second translation members and said left and right support columns, respectively;

wherein each of said first and second handles includes an articulation joint disposed between the translation member and the hand grip and an articulation joint locking mechanism engageable at selected angles.

2. An apparatus as in claim 1, wherein said articulation joint includes an adjustable rotational resistance mechanism.

3. An apparatus as in claim 1, wherein each of said one or more resistance straps removably connectable between each of said first and second translation members and said left and right support columns, respectively, comprises a plurality of resistance straps connected in opposing orientation, such that resistance is created when rotating said translation member in either the clockwise or counter-clockwise directions.

4. An apparatus as in claim 1, further comprising first and second resistance strap pre-tensioners.

5. An apparatus as in claim 1, further comprising:

wherein said left and right support column base portions are adjustably connected to said treadmill so as to vary the lateral separation between said left and right support columns.

6. An apparatus as in claim 1, further comprising:

wherein each of said left and right support column upper portions includes a sleeve adjustably mounted to said support column, and wherein each of said translation members connects to a respective right or left support column sleeve.

7. An apparatus as in claim 1, further comprising:

first and second adjustable grips, each of said adjustable grips including a first portion rotatably and slidingly connected to said first and second handles, respectively, a hand grip portion extending from and offset from said first portion, and a locking mechanism releasably engageable with said first portion and said handle.

8. An integral treadmill resistance training apparatus, comprising:

a treadmill having a forward end, an aft end, and a treadway;

left and right support columns, each of said support columns including a base portion connected to said treadmill and an upper portion extending upward from said base portion;

first and second translation members rotatingly attached to said left and right column upper portions, respectively;

first and second articulated handles, each of said handles having a first part and a second part and an articulation joint connecting said first and second parts, wherein each of said handle first parts is further connectable at a first end to said respective translation member at an adjustable angle to said translation member and at a second end to said articulation joint, and wherein each of said articulation joints includes a locking mechanism engageable with said articulation joint and said handle second part at selectable angles relative to said handle first part, and wherein each of said handle second parts further includes a hand grip; and, a plurality of resistance straps connectable between said translation members and said support columns.

9. An apparatus as in claim 8, wherein each of said first and second handle articulation joints further includes an adjustable rotational resistance mechanism.

10. An apparatus as in claim 9, wherein each of said handle articulation joint adjustable resistance mechanisms comprises one or more friction disks.

11. An apparatus as in claim 8, wherein each of said one or more resistance straps removably connectable between each of said first and second translation members and said left and right support columns, respectively, comprises a plurality of resistance straps connected in opposing orientation, such that resistance is created when rotating said translation member in either the clockwise or counter-clockwise directions.

12. An apparatus as in claim 8, further comprising first and second resistance strap pre-tensioners.

13. An apparatus as in claim 8, further comprising:

wherein said left and right support column base portions are adjustably connected to said treadmill so as to vary the lateral separation between said left and right support columns.

14. An apparatus as in claim 8, further comprising:

wherein each of said left and right support column upper portions includes a sleeve adjustably mounted to said support column, and wherein each of said translation members connects to a respective right or left support column sleeve.

15. An apparatus as in claim 8, further comprising:

first and second adjustable grips, each of said adjustable grips including:

a first portion rotatably and slidingly connected to said first and second handle second parts, respectively:

a hand grip portion extending from and offset from said adjustable grip first portion; and, a locking mechanism releasably engageable with said adjustable grip first portion and said handle second portion, the locking mechanism including a plurality of fixed locking holes and at least one elongated translational locking hole, the elongated translational locking hole to permit partial rotation of the adjustable grips about handle axes.

16. An integral treadmill resistance training apparatus, comprising:

a treadmill having a forward end, an aft end, and a treadway;

left and right support columns, each of said support columns including a base portion connected to said treadmill and an upper portion extending upward from said base portion;

first and second resistance strap bottom anchors projecting outwardly from said left and right support columns, respectively;

first and second translation members rotatingly connected to said right and left support column upper portions, respectively, each of said translation members comprising: a central mounting hole, a plurality of handle indexing holes distributed radially around said central mounting hole at selected angular offsets, and one or more resistance strap connection points radially distal from said central mounting hole;

first and second handles adjustably connected to said first and second translation members, respectively, each of said handles comprising:

a first handle portion extending from a first end connecting to a respective translation member to a second end connecting to an articulation joint, a first handle mounting hole disposed proximal to said handle first end, a second handle mounting hole disposed distally from said first handle mounting hole toward said second end, wherein the distance between said first and second handle mounting holes matches the radial distance between said center mounting hole and said plurality of handle index holes of said translation member; and, a second handle portion extending from a first end connecting to an articulation joint to a grip end; and, an articulation joint rotatingly coupling the handle first and second handle portions, the articulation joint selectively including a locking portion to lock second portion at user selected angles in relation to the first handle portion;

a first axle rotatingly connecting said first handle and said first translation member to said left support column, and a second axle rotatingly connecting said second handle and said second translation member to said right support column;

first and second handle index pins removably engageable with said first and second handles and said first and second translation members, respectively, through said handle second mounting hole and a selected handle index hole; and, a plurality of resistance straps, each of said resistance straps connectable at a first end to the first or second strap anchor and at a second end to to the respective translation member connection point.

17. An apparatus as in claim 16, wherein each of said first and second axles comprises:

an axle post extending outwardly from said support column, said axle post having an axial center through-hole, a rotational bearing mounted to said axle post, a center bolt, and a center bolt retaining nut;

wherein each of said translation members is rotatingly attached to said respective axle post over said bearing, thereby engaging said bearing, and said center bolt extends through said center through hole and said handle first mounting hole and engages said center bolt retaining nut.

18. An apparatus as in claim 16, further comprising:

wherein said left and right support column base portions are adjustably connected to said treadmill so as to vary the lateral separation between said left and right support columns.

19. An apparatus as in claim 16, further comprising:

wherein each of said left and right support column upper portions includes a sleeve adjustably mounted to said support column, and wherein each of said translation members connects to a respective right or left support column sleeve and further wherein each of said first and second bottom anchors projects from said left and right support column sleeves, respectively.

20. An apparatus as in claim 1, wherein:

each of said first and second hand grips are adjustable, and the first and second hand grips include:

a first portion rotatably and slidingly connected to said first and second handle second ends, respectively;

a grip portion extending from and offset from said adjustable grip first portion; and, a locking mechanism releasably engageable with said adjustable hand grip first portion and said handle second portion, the locking mechanism including a plurality of fixed locking holes and at least one elongated translational locking hole, the elongated translational locking hole to permit partial rotation of the first and second hand grips about their respective handle axes.

21. An apparatus as in claim 7, each of the first and second adjustable grips further comprising:

a plurality of fixed locking holes and at least one elongated translational locking hole, the elongated translational locking hole to permit partial rotation of the adjustable grips about handle axes.

22. An apparatus as in claim 16, further comprising:

each of said first and second handle grip ends comprising adjustable grips including:

a first portion rotatably and slidingly connected to said first and second handle second portions, respectively;

a hand grip portion extending from and offset from said adjustable grip first portion; and, a locking mechanism releasably engageable with said adjustable grip first portion and said handle second portion, the locking mechanism including a plurality of fixed locking holes and at least one elongated translational locking hole, the elongated translational locking hole to permit partial rotation of the adjustable grips about handle axes.

* * * * *